US009640307B2

(12) United States Patent
Miyamoto et al.

(10) Patent No.: US 9,640,307 B2
(45) Date of Patent: May 2, 2017

(54) TRANSFORMER

(71) Applicant: FDK CORPORATION, Tokyo (JP)

(72) Inventors: Masami Miyamoto, Tokyo (JP); Yutaka Ikeda, Tokyo (JP); Akihiro Fujii, Tokyo (JP)

(73) Assignee: FDK CORPORATION, Tokyo (JP)

( * ) Notice: Subject to any disclaimer, the term of this patent is extended or adjusted under 35 U.S.C. 154(b) by 56 days.

(21) Appl. No.: 14/648,831

(22) PCT Filed: Oct. 29, 2013

(86) PCT No.: PCT/JP2013/006385
§ 371 (c)(1),
(2) Date: Jun. 1, 2015

(87) PCT Pub. No.: WO2014/103121
PCT Pub. Date: Jul. 3, 2014

(65) Prior Publication Data

US 2015/0318098 A1 Nov. 5, 2015

(30) Foreign Application Priority Data

Dec. 27, 2012 (JP) ..... 2012-285024

(51) Int. Cl.
*H01F 27/30* (2006.01)
*H01F 27/29* (2006.01)
(Continued)

(52) U.S. Cl.
CPC ..... *H01F 5/02* (2013.01); *H01F 27/325* (2013.01); *H01F 30/00* (2013.01);
(Continued)

(58) Field of Classification Search
CPC ..... H01F 5/04; H01F 27/306; H01F 27/325; H01F 5/02; H01F 30/06
(Continued)

(56) References Cited

U.S. PATENT DOCUMENTS 6,522,233 B1 * 2/2003 Kyoso ..... H01F 27/324 336/192
2011/0115598 A1 * 5/2011 Wu ..... H01F 27/325 336/212
2012/0154089 A1 * 6/2012 Eom ..... H01F 27/30 336/105

FOREIGN PATENT DOCUMENTS

JP 54-66118 5/1979
JP 2001-267153 9/2001
(Continued)

OTHER PUBLICATIONS

International Search Report issued Feb. 4, 2014 in International (PCT) Application No. PCT/JP2013/006385.

*Primary Examiner* — Tsz Chan
(74) *Attorney, Agent, or Firm* — Wenderoth, Lind & Ponack, L.L.P.

(57) ABSTRACT

A transformer in which the high-voltage and low-voltage coils are easily laminated when they are alternately laminated in their axial directions, improving power efficiency. The transformer includes: a high-voltage coil including a wire wound around a cylindrical winding drum of a bobbin which is provided with flanges on both ends of the winding drum; a low-voltage coil formed of a flat plate member having an open ring shape, the low-voltage and high-voltage coils being alternately laminated in their axial directions; and a cover member which has a ring plate shape and is coaxially laminated on an outside of a laminate in an axial direction. The low-voltage coil is between the high-voltage coil and the cover member, and a wall portion protruding in the axial direction from the bobbin of the high-voltage coil and a wall portion protruding in the axial direction of the cover member are alternately disposed.

4 Claims, 7 Drawing Sheets

(51) Int. Cl.

| | |
|---|---|
| ***H01F 27/28*** | (2006.01) |
| ***H01F 5/02*** | (2006.01) |
| ***H01F 30/00*** | (2006.01) |
| ***H01F 27/32*** | (2006.01) |

(52) U.S. Cl.
CPC .... *H01F 27/2823* (2013.01); *H01F 2005/022* (2013.01); *H01F 2005/025* (2013.01)

(58) Field of Classification Search
USPC ..... 336/192, 196, 198, 208, 220, 222
See application file for complete search history.

(56) References Cited

FOREIGN PATENT DOCUMENTS

| | | |
|---|---|---|
| JP | 2001-284142 | 10/2001 |
| JP | 2002-359110 | 12/2002 |

* cited by examiner

TRANSFORMER

TECHNICAL FIELD

The present invention relates to a transformer used as a power transformer and the like in which large current flows through a low-voltage coil.

BACKGROUND ART

There has been generally used a transformer in which large current of 100 A or more flows through a low-voltage coil on a secondary side, for a power transformer or a DC-DC converter used for an electric car, a larger server or the like. In such a transformer, a flat metal plate having a small resistance is normally used for the low-voltage coil in order to accommodate increased current.

In the case where the low-voltage coil is formed of the flat metal plate, the low-voltage coil on the secondary side and a high-voltage coil on a primary side cannot have a layer winding structure, and thus there has been adopted a structure in which the low-voltage coil and the high-voltage coil are separately disposed. However, some of such structures have a problem of difficulty to obtain desired characteristics due to insufficient coupling.

Therefore, as illustrated in FIGS. 5 to 8, there has been conventionally used a transformer 10 in which a high-voltage coil 20 with a wire t wound around a winding drum 40*a* of a bobbin 40, and a low-voltage coil 30 formed of a flat plate member having an open ring shape, are alternately laminated in their axial directions, and cover members 50 each having a ring plate shape are coaxially laminated on outsides of the laminate in its axial direction. Note that reference character 40*b* denotes a flange of the bobbin 40. The reference numeral 60 denotes each of a pair of E ferrite cores surrounding the low-voltage coils 30 and the high-voltage coil 20 to form a figure-8 shaped closed magnetic path. The cover member 50 is an insulation member and interposed between the E-shaped ferrite core 60 and the low-voltage coil 30.

In the conventional transformer 10 configured as described above, the high-voltage coil 20 is sandwiched between the two low-voltage coils 30, so that coupling can be enhanced, thereby obtaining excellent characteristics.

The power transformer 10 having the above structure is also disclosed in Patent Literature 1, for example, recited below.

CITATION LIST

Patent Literature

Patent Literature 1: Japanese Patent Laid-Open No. 2001-267153

SUMMARY OF INVENTION

Technical Problem

In the transformer 10 having the conventional structure described above, in order to improve the characteristics by further enhancing the coupling, it is conceivable to adopt a structure in which the high-voltage coil 20 also has a divided structure and the divided high-voltage coils 20 sandwich the low-voltage coil 30, and the plurality of low-voltage coils 30 and high-voltage coils 20 are alternately laminated in the axial direction.

However, in the transformer 10 in which the plurality of low-voltage coils 30 and high-voltage coils 20 are alternately laminated in the axial direction, alignment is troublesome during assembly, which lowers work efficiency. Further, even when the alignment and assembly are successful, gaps are generated between the respective coils because of play in the axial direction, which causes displacement of the coils in a radial direction. Therefore, obtaining desired characteristics is difficult, which lowers product quality.

Further, in order to accommodate increased current, a sectional area is increased by increasing a plate thickness and a width of the low-voltage coil 30 formed of the flat plate member. However, in such a case, there is a problem of increased size of the transformer 10 itself.

The present invention has been made in view of such circumstances and an object thereof is to provide a transformer in which a high-voltage coil and a low-voltage coil are easily laminated when they are alternately laminated in their axial directions, and power efficiency can be improved.

Solution to Problem

In order to solve the above problems, the invention described in a first aspect of the invention is a transformer including: a high-voltage coil 2 including a wire 9 wound around a cylindrical winding drum 4*a* of a bobbin 4 which is provided with flanges 4*b* on both ends of the winding drum 4*a*; a low-voltage coil 3 formed of a flat plate member having an open ring shape, the low-voltage coil 3 and the high-voltage coil 2 being alternately laminated in axial directions of the low-voltage coil and the high-voltage coil; and a cover member 5 which has a ring plate shape and is coaxially laminated on an outside of a laminate in an axial direction. In the transformer, the low-voltage coil 3 is disposed between the high-voltage coil 2 and the cover member 5, and a wall portion 2*a*, 2*b* protruding in the axial direction from the bobbin 4 of the high-voltage coil 2 and a wall portion 5*a* protruding in the axial direction of the cover member 5 are alternately disposed along an inner circumferential surface of the low-voltage coil 3 to be positioned in a circumferential direction.

Further, in the invention described in a second aspect of the invention, in the invention described in the first aspect, two or more of the high-voltage coils are disposed in the axial direction, the low-voltage coil is disposed between the high-voltage coils, and the wall portions of the high-voltage coils are alternately disposed along the inner circumferential surface of the low-voltage coil to be positioned in the circumferential direction.

Further, in the invention described in a third aspect, in the invention described in first or second aspects, two or more of the low-voltage coils are coaxially laminated with an insulation sheet interposed between the low-voltage coils.

Advantageous Effects of Invention

According to the present invention described in the first to third aspects of the invention, a low-voltage coil is disposed between a high-voltage coil and a cover member to be laminated in an axial direction, and a wall portion protruding in the axial direction from a bobbin of the high-voltage coil, and a wall portion protruding in the axial direction of the cover member are alternately disposed along an inner circumferential surface of the low-voltage coil to be positioned in a circumferential direction. Thus, assembly work can be facilitated and displacement of the low-voltage coil in a radial direction can be prevented. Thereby, productivity can be improved, which can lead to an improvement of product quality.

According to the invention described in the second aspect of the invention, two or more of the high-voltage coils are disposed in the axial direction, the low-voltage coil is disposed between the high-voltage coils, and the wall portions of the high-voltage coils are alternately disposed along the inner circumferential surface of the low-voltage coil to be positioned in the circumferential direction. Thus, even when the plurality of high-voltage coils and low-voltage coils are laminated to be disposed, they can be easily assembled. As a result, productivity can be improved and a yield ratio can be improved.

According to the invention described in the third aspect of the invention, two or more of the low-voltage coils are coaxially laminated with an insulation sheet interposed between the low-voltage coils. Thus, current efficiency can be improved without increasing a thickness and a width of the low-voltage coil. Thus, large current transformer can be downsized.

Further, since the wall portion protruding from the bobbin of the high-voltage coil, and the wall portion protruding from the cover member come into contact with the inner circumferential surface of the low-voltage coil, even when the insulation sheet is interposed between the laminated low-voltage coils, the insulation sheet is not displaced in a radial direction, and thus the low-voltage coils can be prevented from contacting each other.

DESCRIPTION OF EMBODIMENTS

Figure 1:
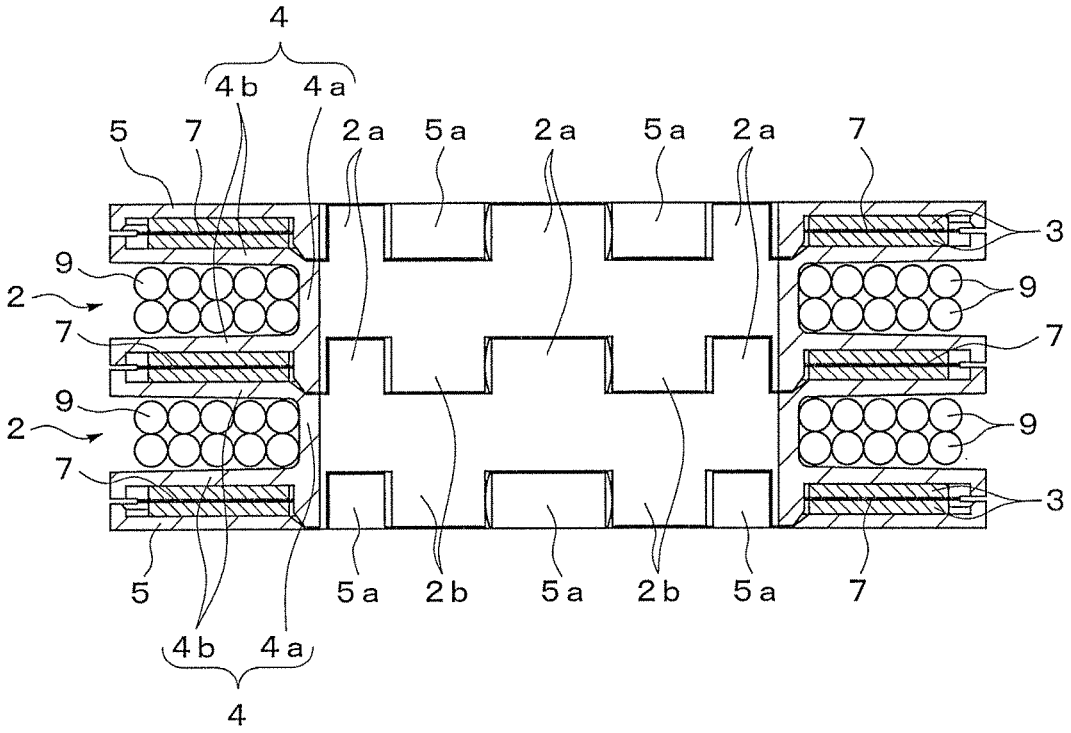
FIG. 1 is a sectional view of a transformer of an embodiment of the present invention in an axial direction in a state that it is not surrounded with E-shaped ferrite cores.
Figure 2:
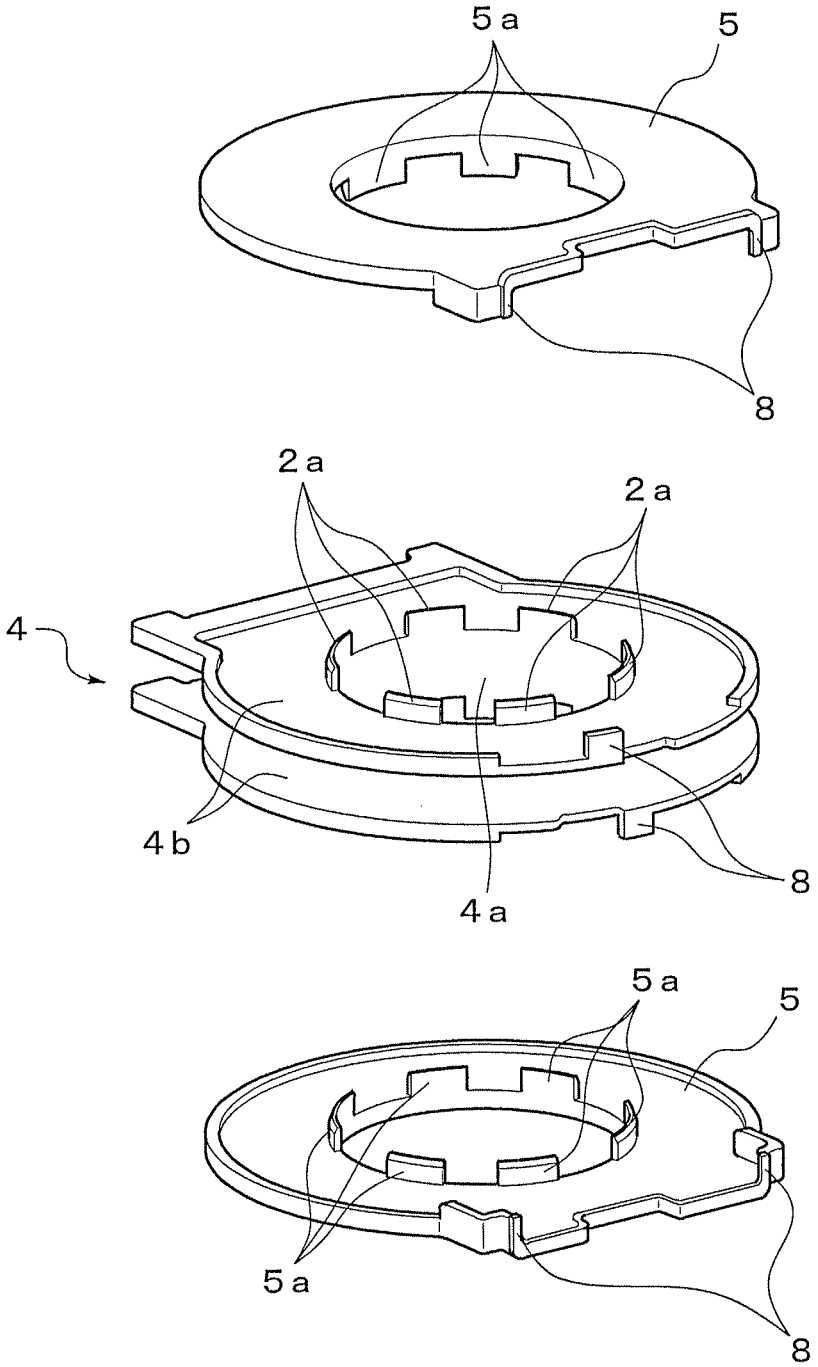
FIG. 2 is a perspective view illustrating a bobbin of a high-voltage coil and cover members used in the transformer of the embodiment of the present invention.
Figure 3:
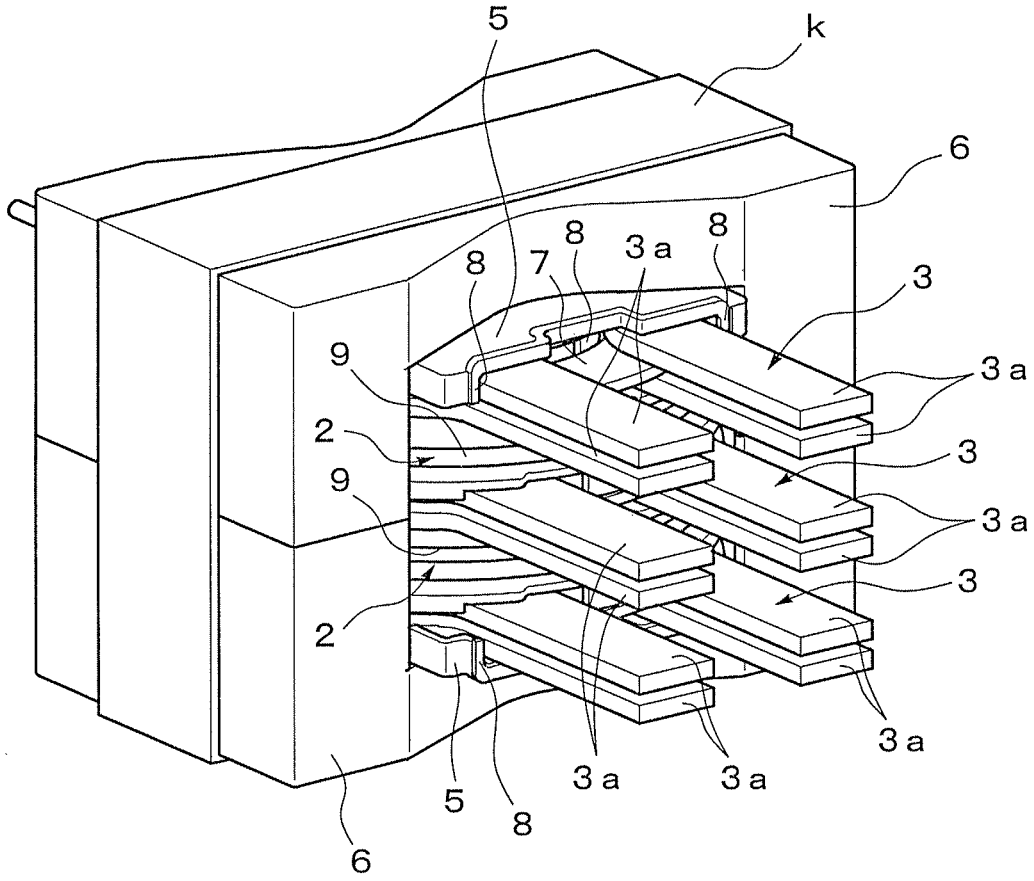
FIG. 3 is a perspective view illustrating the transformer of the embodiment of the present invention.

FIGS. 1 to 4 each illustrate an embodiment of a transformer according to the present invention. The transformer 1 is generally composed of two high-voltage coils 2 as a primary side, three sets of low-voltage coils 3 as a secondary side, two cover members 5, and E-shaped ferrite cores 6 surrounding the high-voltage coils 2, the low-voltage coils 3, and the cover members 5 to form a closed magnetic path.

Herein, the low-voltage coil 3 is a flat plate member having an open ring shape which is formed by punching a copper plate. Both ends of the low-voltage coil 3 are integrally provided with terminals 3*a* extending outward. Further, an insulation sheet 7 is interposed between the two low-voltage coils 3, and the low-voltage coils 3 are coaxially laminated. Further, the insulation sheet 7 is formed of a flat plate member having a circular ring shape.

Further, the high-voltage coil 2 has an outside appearance of a substantially cylindrical shape. In the high-voltage coil 2, a bobbin 4 in which both ends of a cylindrical winding drum 4*a* having insulation property are provided with flanges 4*b*, and the bobbin 4 is wound with a triple insulated winding wire (wire) 9. Further, the high-voltage coil 2 is provided with wall portions 2*a*, 2*b* which come into contact with respective inner circumferential surfaces of the two low-voltage coils 3 when the set of the low-voltage coils 3 are laminated on both ends of the high-voltage coil 2 in the axial direction.

The wall portions 2*a*, 2*b* protrude outward in the axial direction from the bobbin 4 of the high-voltage coil 2, and the plurality (six in the figure) of wall portions 2*a*, 2*b* are formed at intervals in a circumferential direction of the inner circumferential surface of the low-voltage coil 3. Further, the wall portions 2*a* and 2*b* each have a height which is the same as a thickness of the set of low-voltage coils 3, are formed at the same intervals as each other, and alternately disposed in the circumferential direction of the low-voltage coil 3.

Further, on a peripheral portion of each flange 4*b* of the bobbin 4, there is formed a rotation stop member 8 protruding outward in the axial direction. The rotation stop members 8 are inserted into between the terminals 3*a* of the two low-voltage coils 3 and are alternately disposed such that one of the rotation stop members 8 comes into contact with inner ends of one of the terminals 3*a*, and the other rotation stop member 8 comes into contact with inner ends of the other terminals 3*a* when the set of low-voltage coils 3 are disposed between the two high-voltage coils 2.

The cover member 5 has a ring plate shape and has insulation property. The cover member 5 is provided with wall portions 5*a* which come into contact with the respective inner circumferential surfaces of the two low-voltage coils 3 when the set of low-voltage coils 3 are disposed between the high-voltage coils 2.

The wall portions 5*a* protrude outward in the axial direction from one end of the cover member 5, and the plurality (six in the figure) of wall portions 5*a* are formed at intervals in the circumferential direction of the inner circumferential surface of the low-voltage coil 3. The wall portions 5*a* have a height which is the same as the height of the wall portions 2*a* and 2*b* provided on both the ends of the bobbin 4 of the high-voltage coil 2, and are formed at the same intervals as the wall portions 2*a* and 2*b*.

Further, the wall portions 5*a* of one of the cover members 5 and the wall portions 2*a* provided on one end of the bobbin 4 of the high-voltage coil 2 are alternately formed in the circumferential direction of the low-voltage coil 3, and the wall portions 5*a* of the other cover member 5 and the wall portions 2*b* provided on the other end of the bobbin 4 of the high-voltage coil 2 are alternately formed in the circumferential direction of the low-voltage coil 3.

Further, on a peripheral portion of the cover member 5, there are formed rotation stop members 8 protruding outward in the axial direction. The rotation stop members 8 are formed at positions where they come into contact with outer ends of the two terminals 3*a* of the two low-voltage coils 3 when the set of low-voltage coils 3 are disposed between the high-voltage coil 2 and the cover member 5.

When the transformer 1 configured as described above is assembled, first, the winding drum 4*a* of the bobbin 4 of one of the high-voltage coils 2 is wound with the triple insulated winding wire 9 by alpha winding, and then the winding drum 4*a* of the bobbin 4 of the other high-voltage coil 2 is wound with the triple insulated winding wire 9 extending from one of the high-voltage coils 2. Thus, the two high-voltage coils 2 with which one triple insulated winding wire 9 is continuously wound are prepared.

Figure 4:
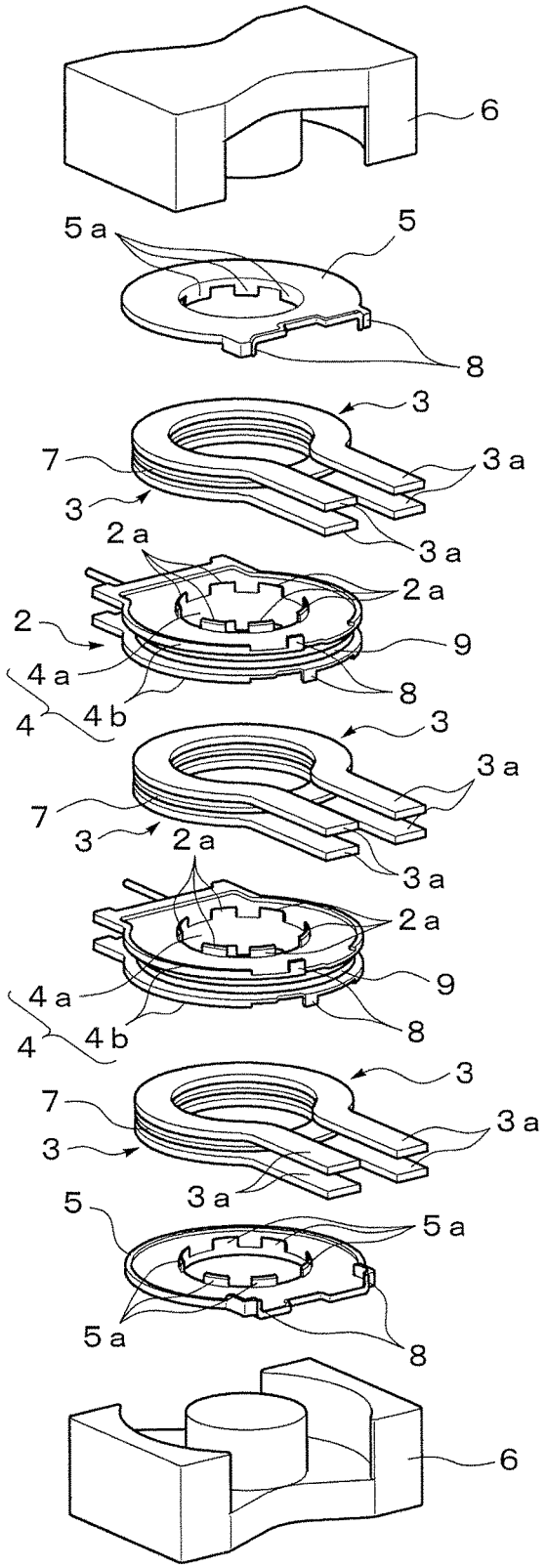
FIG. 4 is a perspective view illustrating a state that the transformer of FIG. 3 is exploded.
Figure 5:
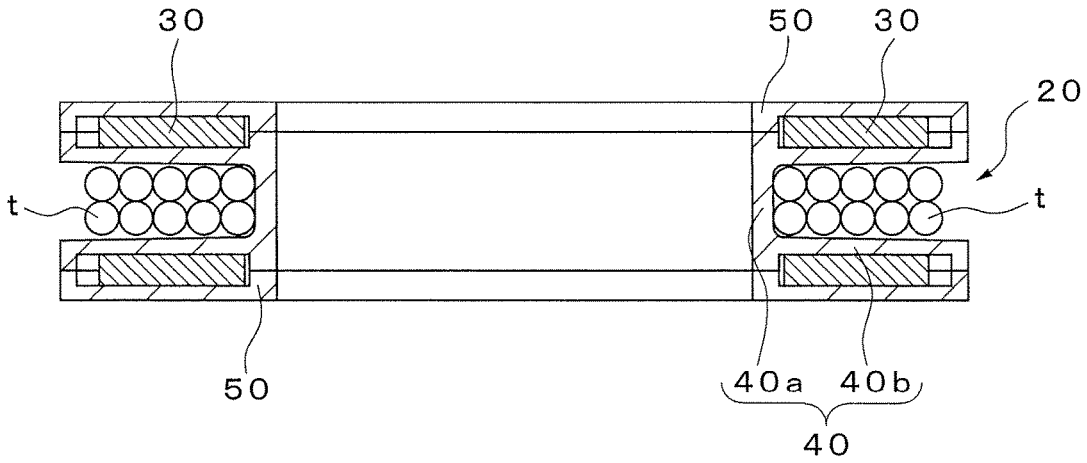
FIG. 5 (PRIOR ART)
FIG. 5 is a sectional view of a conventional transformer in an axial direction in a state that it is not surrounded with E-shaped ferrite cores.
Figure 7:
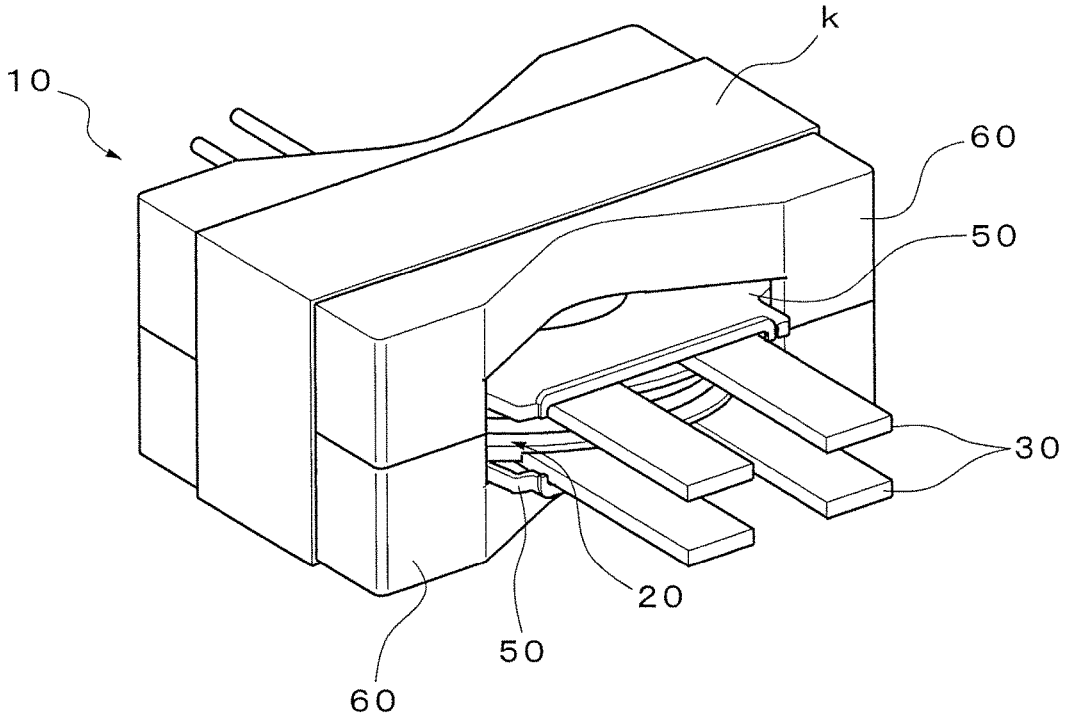
FIG. 7 (PRIOR ART)
FIG. 7 is a perspective view of the conventional transformer in which the high-voltage coil and a plurality of low-voltage coils are laminated.
Figure 6:
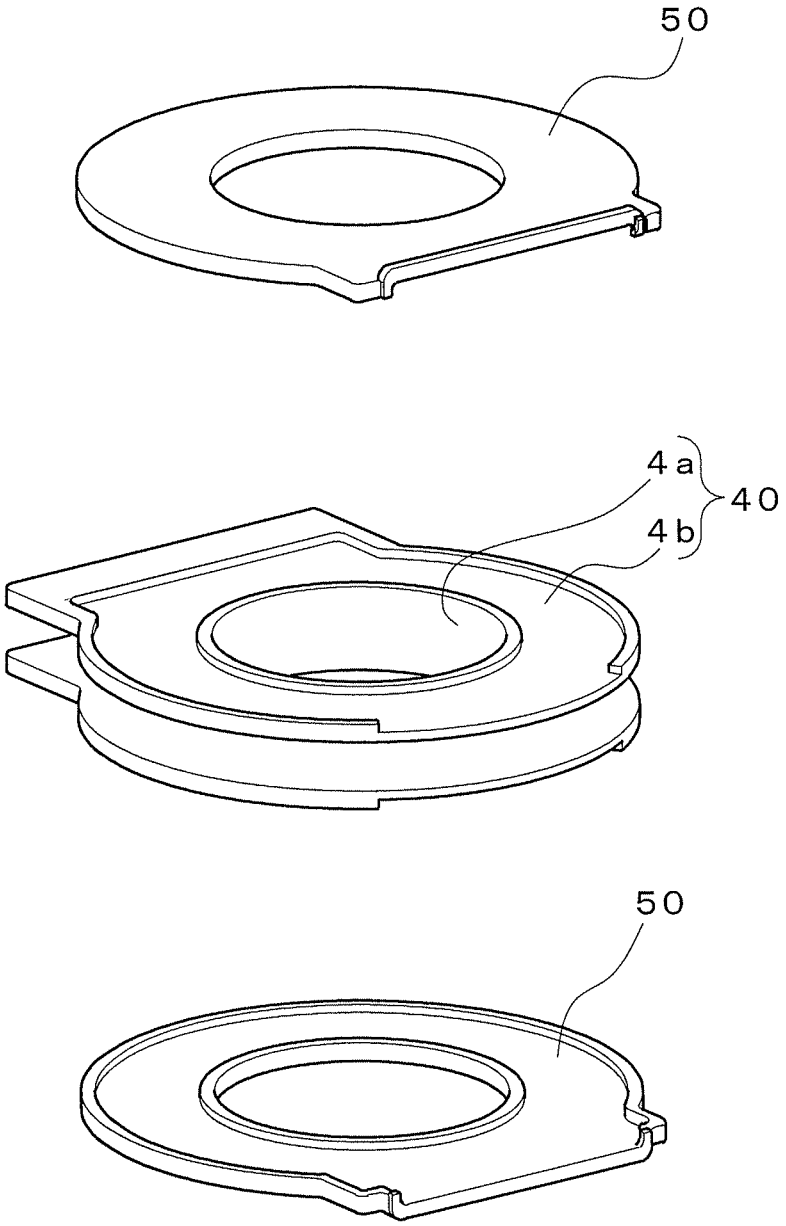
FIG. 6 (PRIOR ART)
FIG. 6 is a perspective view illustrating a bobbin of a high-voltage coil and cover members in the transformer of FIG. 5.
Figure 8:
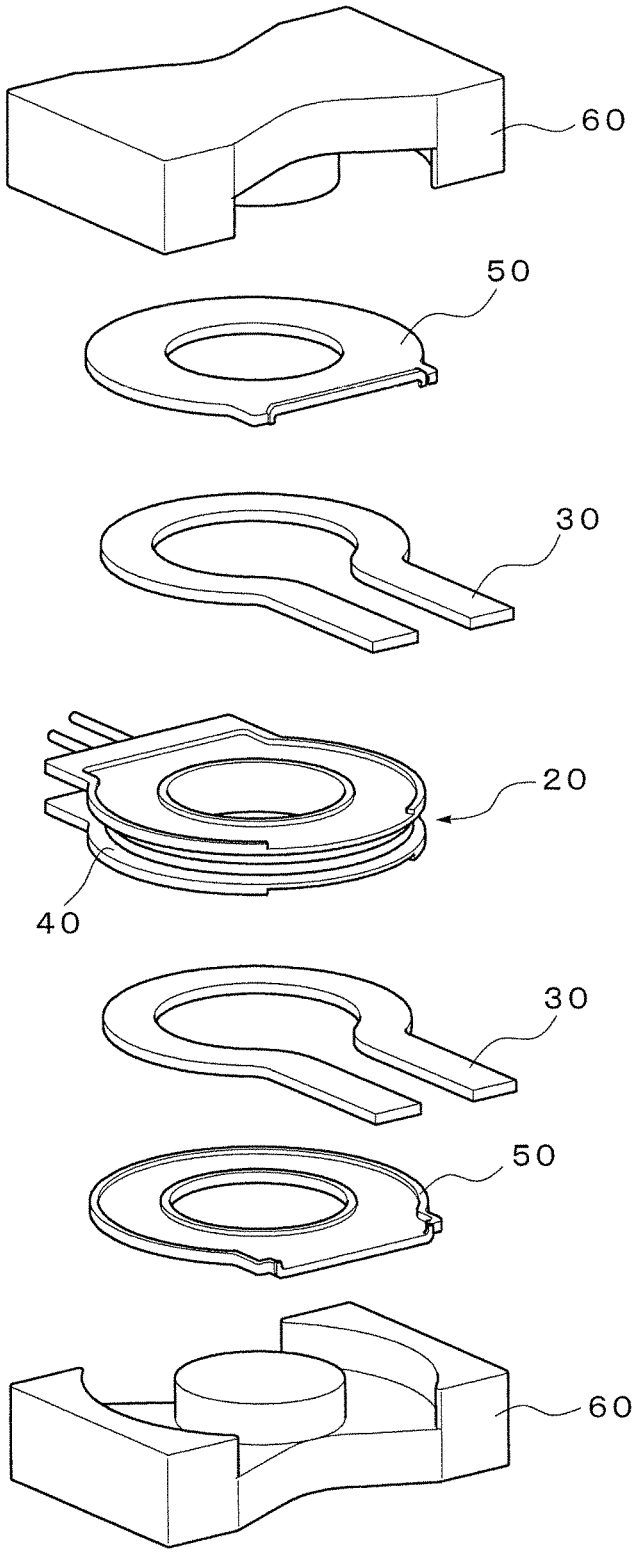
FIG. 8 (PRIOR ART)
FIG. 8 is a perspective view illustrating a state that the transformer of FIG. 7 is exploded.

Next, as illustrated in FIG. 4, the set of low-voltage coils 3 are disposed such that they are sandwiched between the two high-voltage coils 2. At the same time, the wall portions 2*a* provided on one of the high-voltage coils 2, and the wall portions 2*b* provided on the other high-voltage coil 2 are fitted, the two high-voltage coils 2 are positioned, and also the low-voltage coil 3 is positioned at the same time because the wall portions 2*a*, 2*b* of the two high-voltage coils 2 come into contact with the respective inner circumferential surfaces of the two low-voltage coils 3.

Further, when the set of low-voltage coils 3 are disposed between the two high-voltage coils 2 to be assembled, the rotation stop member 8 provided on the flange 4*b* of the bobbin 4 of one of the high-voltage coils 2 comes into contact with the inner ends of the terminals 3*a* on one side of the two low-voltage coils 3, and the rotation stop member 8 provided on the flange 4*b* of the bobbin 4 of the other high-voltage coil 2 comes into contact with the inner ends of the terminals 3*a* on the other side of the two low-voltage coils 3. Thus, the set of low-voltage coils 3 are prevented from rotating in the circumferential direction.

Then, on both the ends in the axial direction of the laminated two high-voltage coils 2, the set of low-voltage coils 3 are disposed such that they are sandwiched between the high-voltage coil 2 and the cover member 5. At the same time, the wall portions 2*a* provided on one end side of the laminated high-voltage coils 2 are respectively fitted to the wall portions 5*a* of one of the cover members 5, and the wall portions 2*b* provided on the other end side of the high-voltage coils 2 are respectively fitted to the wall portions 5*a* of the other cover member 5. Accordingly, the cover members 5 are respectively positioned on the laminated high-voltage coils 2. Further, the wall portions 2*a* of the laminated high-voltage coils 2 and the wall portions 5*a* of the cover member 5, and the wall portions 2*b* of the laminated high-voltage coils 2 and the wall portions 5*a* of the cover member 5 come into contact with the respective inner circumferential surfaces of the two sets of low-voltage coils, and thus the two sets of low-voltage coils 3 are positioned at the same time.

Further, when the set of low-voltage coils 3 are disposed between the high-voltage coil 2 and the cover member 5 to be assembled, the rotation stop member 8 provided on the flange 4*b* of the bobbin 4 of the high-voltage coil 2 comes into contact with the insides of the terminals 3*a* on one side of the two low-voltage coils 3, and the two rotation stop members 8 provided on the circular edge of the cover member 5 come into contact with the outsides of the terminals 3*a* of one of the low-voltage coils 3. Thereby, the set of low-voltage coils 3 are prevented from rotating in the circumferential direction.

Then, the pair of E-shaped ferrite cores 6 surround the two high-voltage coils 2, the three sets of low-voltage coils 3, and the two cover members 5 to fit them with a binding member k, so that the assembly of the transformer 1 is completed.

In the transformer 1 configured as described above, the three sets of low-voltage coils 3 are respectively disposed between the two high-voltage coils 2 and between the high-voltage coils 2 and the cover members 5 to be laminated in the axial direction, and the wall portions 2*a*, 2*b* protruding in the axial direction from the bobbin 4 of the high-voltage coil 2, and the wall portions 5*a* protruding in the axial direction of the cover member 5 are alternately disposed along the inner circumferential surface of the low-voltage coil 3 to be positioned in the circumferential direction. Thus, assembly work can be facilitated and displacement of the sets of low-voltage coils 3 in the radial direction can be prevented. Thereby, productivity can be improved, which can lead to an improvement of product quality. Further, even when the bobbins 4 of the high-voltage coils 2 are an elliptical shape, for example, the high-voltage coils 2 can be positioned in the same direction as each other when they are laminated in their axial directions.

Further, since the low-voltage coils 3 are coaxially laminated with the insulation sheet 7 interposed therebetween, current efficiency can be improved without increasing the thickness and the width of the low-voltage coil 3. As a result, the large current transformer can be downsized.

Further, since the wall portions 2*a*, 2*b* protruding from the bobbins 4 of the high-voltage coils 2, and the wall portions 5*a* protruding from the cover members 5 come into contact with the respective inner circumferential surfaces of the three sets of the low-voltage coils 3, even when the insulation sheet 7 is interposed between the three sets of the low-voltage coils of each set of the low-voltage coils 3, the insulation sheet 7 is not displaced in a radial direction, and thus the low-voltage coils 3 can be prevented from contacting each other.

In the embodiment described above, the description is given to the case of the transformer 1 according to the present invention in which the two high-voltage coils 2 and the three sets of low-voltage coils 3 are alternately disposed and laminated in the axial direction. However, the present invention is not limited to this and the present invention can be configured by combining the more high-voltage coils 2 and low-voltage coils 3.

Further, the wire for forming the high-voltage coil 2 is not limited to the triple insulated winding wire 9 described above, and various kinds of wires can be used depending on specifications of the transformers.

As to the low-voltage coil 3, a wire having a large wire diameter can be used instead of the flat plate member having the open ring shape described above depending on magnitude of flowing current.

INDUSTRIAL APPLICABILITY

The present invention can be used for a large current transformer such as a power transformer or a DC-DC converter used for an electric car, a larger server or the like.

REFERENCE SIGNS LIST

1 transformer
2 high-voltage coil
2*a*, 2*b* wall portion
3 low-voltage coil
4 bobbin
4*a* winding drum
4*b* flange
5 cover member
5*a* wall portion
6 E-shaped ferrite core
7 insulation sheet
8 low-voltage coil rotation stop member
9 wire

10 transformer
20 high-voltage coil
30 low-voltage coil
40 bobbin
40*a* winding drum
40*b* flange
50 cover member
60 E-shaped ferrite core
t wire

The invention claimed is:

1. A transformer comprising:

high-voltage coils including a wire wound around a cylindrical winding drum of a bobbin which is provided with flanges on both ends of the winding drum;

low-voltage coils formed of a flat plate member having an open ring shape, the low-voltage coils and high-voltage coils being alternately laminated in axial directions of the low-voltage coils and high-voltage coils; and a cover member which has a ring plate shape and is coaxially laminated on an outside of a laminate in an axial direction, wherein one of the low-voltage coils are disposed between one of the high-voltage coils and the cover member, and a first set of wall portions protruding in the axial direction from the bobbin of one of the high-voltage coils and wall portions protruding in the axial direction of the cover member are alternately disposed along an inner circumferential surface of one of the low-voltage coils to be positioned in a circumferential direction;

wherein the first set of wall portions of the bobbin of one of the high-voltage coils each have a height which is the same as a thickness of the low-voltage coils, and are formed at same intervals as each other;

wherein the wall portions of the cover member have a height which is the same as the height of the first set of wall portions of the bobbin of one of the high-voltage coils; and wherein another one of the low-voltage coils are disposed such that they are sandwiched between the high-voltage coils, and a second set of wall portions of the bobbin of one of the high-voltage coils and the wall portions of the bobbin of another one of the high-voltage coils are fitted, the high-voltage coils being positioned so that a second set of wall portions of the bobbin of one of the high-voltage coils and the wall portions of the bobbin of another one of the high-voltage coils come into contact with inner circumferential surfaces of adjacent ones of another one of the low-voltage coils.

2. The transformer according to claim 1, wherein two or more of the high-voltage coils are disposed in the axial direction, the low-voltage coils being disposed between the two or more high-voltage coils, and the wall portions of the bobbins of the two or more high-voltage coils being alternately disposed along the inner circumferential surface of the low-voltage coils to be positioned in the circumferential direction.

3. The transformer according to claim 1, wherein in the low-voltage coils, two or more of the flat plate members each having the open ring shape are coaxially laminated with an insulation sheet interposed between the flat plate members.

4. The transformer according to claim 2, wherein in the low-voltage coils, two or more of the flat plate members each having the open ring shape are coaxially laminated with an insulation sheet interposed between the flat plate members.

* * * * *